US005509330A

United States Patent [19]

Nick

[11] Patent Number: 5,509,330

[45] Date of Patent: Apr. 23, 1996

[54] FASTENER SUPPORT APPARATUS

[76] Inventor: Edward V. Nick, 512 Lexington Ave., Fox River Grove, Ill. 60021

[21] Appl. No.: 409,343

[22] Filed: Mar. 23, 1995

[51] Int. Cl.[6] ..... B25B 13/00; B25B 23/00

[52] U.S. Cl. ..... 81/55; 81/52; 81/54; 81/429

[58] Field of Search ..... 81/55, 54, 429, 81/57.4

[56] References Cited

U.S. PATENT DOCUMENTS

| | | | |
|---|---|---|---|
| 2,310,287 | 2/1943 | Hausbeck | 145/52 |
| 2,633,169 | 4/1950 | Siems | 145/52 |
| 2,728,365 | 12/1955 | Austin | 81/54 |
| 2,774,401 | 12/1956 | Hallam | 145/52 |
| 2,840,126 | 6/1958 | Schmitt | 144/32 |
| 2,845,968 | 8/1958 | Luber | 144/32 |
| 2,884,971 | 5/1959 | Dierker | 145/52 |
| 3,757,407 | 9/1973 | Bomar | 29/212 R |
| 3,934,629 | 1/1976 | Boman | 81/429 |
| 4,058,885 | 11/1977 | Bergman | 29/559 |
| 4,140,161 | 2/1979 | Russo et al. | 145/52 |
| 4,237,946 | 12/1980 | Leitner | 81/429 |
| 4,653,358 | 3/1987 | Lankry | 81/474 |
| 4,924,732 | 5/1990 | Hoskins et al. | 81/54 |
| 4,936,169 | 6/1990 | Parsons | 81/57.37 |
| 5,207,127 | 5/1993 | Nick | 81/54 |
| 5,341,704 | 8/1994 | Klemm | 81/52 |
| 5,341,708 | 8/1994 | Nick | 81/451 |
| 5,431,660 | 7/1995 | Burke | 81/429 |

FOREIGN PATENT DOCUMENTS

| | | | |
|---|---|---|---|
| 4238537 | 5/1994 | Germany | 81/52 |
| 2015428 | 9/1992 | WIPO | 81/52 |

*Primary Examiner*—Willis Little
*Attorney, Agent, or Firm*—Godfrey & Kahn

[57] ABSTRACT

A fastener support apparatus for facilitating the installation of individual screws into a work surface, and wherein the fastener support apparatus works in combination with a drive assembly having a clutch. The fastener support apparatus includes a drive shaft oriented in force receiving relation relative to the clutch; a depth adjustment assembly located in a predetermined orientation relative to the drive shaft; a rotatable bit for engaging the head of a screw and which is disposed in force receiving relation relative to the drive shaft; a base member fixed on the rotatable bit; a sleeve telescopingly borne by the base and reciprocally moveable relative thereto; and a screw support assembly reciprocally borne by the base member and matingly interfitted with the sleeve. The screw support assembly defines a screw receiving station which is operable to receive the head of the screw. The fastener support apparatus also includes a locking assembly borne by the screw support assembly and which is operable to release the head of the screw when disposed in a predetermined orientation. The fastener support apparatus also includes an actuating assembly borne by the screw support assembly.

19 Claims, 6 Drawing Sheets

FASTENER SUPPORT APPARATUS

BACKGROUND OF THE INVENTION

1. Field of the Invention

The present invention relates generally to an apparatus for facilitating the installation of individual fasteners, such as screws and the like, and more particularly to an apparatus which is operable to releasably secure the head of an individual screw in a predetermined location relative to a rotatable bit, thereby facilitating the installation of the screw into a work piece, and more particularly to such an apparatus which may be operated in combination with a drywall/deck gun which has a conventional clutch mechanism.

2. Description of the Prior Art

During the construction of buildings, or in the manufacture of various articles of commerce, it is typically necessary for a worker to install numerous screws or other types of threaded fasteners into assorted work pieces by employing power screw driving tools having various configurations and designs. For example, in the construction of dwellings, work pieces which may be joined to other objects or surfaces by threaded fasteners may include sheet-like materials such as drywall, decorative paneling, plywood subflooring, and the like. These materials, of course, have different textures, and also may be positioned in assorted locations and orientations which may, from time to time, present problems with regard to installing a screw type fastener in the respective materials. For example, the tough texture of sheet-like materials such as exterior-grade plywood may present difficulties in starting the threaded fasteners because these substrates may be positioned in locations well above the head of the construction worker. Alternatively, as in the case of installing a subfloor, it may require the worker to remain on his knees for extended periods of time or bend repeatedly to install fasteners in the surface.

Moreover, and during the installation of screws or other fasteners which have a substantial length dimension, the slotted portion of the screw head will often become distorted or burred by the rotatable bit of the power screwdriver when the bit temporarily disengages from the screw head. When this event occurs, installation or removal of the screw often becomes difficult. Moreover, the aesthetic appearance of an object may be adversely affected by this distortion. To prevent or otherwise inhibit this distortion or burring of a screw head or further to insure that the screw is being started in an appropriate fashion in a work piece which is not provided with a pilot hole, it is often necessary to apply substantial physical force to the powered screwdriver, thereby securely positioning the screw in tight mating engagement with the rotatable bit. Further, and if the screw is being installed in material which is rather hard, such as pressure treated lumber, this physical force will need to be maintained until the screw is installed completely into the material.

Heretofore, various standard drywall/deck guns have been employed and which have been utilized to install threaded fasteners in various substrates. These prior art drywall/deck guns employ similar technology, that is, these standard guns use a magnet to hold the fastener to the drive mechanism of the respective units and further employ a spring mechanism which disengages the associated clutch mechanism when the screw or fastener has been countersunk to a predetermined depth in the substrate. In this regard, the clutch mechanism employed in the prior-art devices includes two similar but opposing discs or members which have mating surfaces, and which releasably lock together when transmitting power and then slide apart or separate a given distance to stop the transmission of power, thereby preventing further movement of the screw into the substrate. As should be understood, the spring is positioned between these discs and forces the discs to a disengaged position when no physical force is being applied to the rotatable bit.

As noted above, physical force which is applied to the rotatable bit, places the individual clutch discs in an engaged or power transmitting position. When a fastener is placed on the bit of the drywall/deck gun, it is held there magnetically, and is then pushed against the work surface. As the operator applies force, the rotatable bit is urged rearwardly thereby forcing the clutch plates or discs together and thus allowing the transmission of force to the fastener. When the clutch discs are no longer forced together, the clutch disengages under the influence of the aforementioned spring. It should be understood that this disengagement of the clutch is controlled by the spatial relationship of the drive train to the nose piece of the drywall/deck gun. In this regard, as the fastener is driven further into a given work surface, the nose piece of the deck gun eventually comes into contact with the work surface. As the fastener continues to be driven into the work piece, the spring, which is disposed between the clutch plates or discs, can now push the discs apart, thereby starting the process of disengaging the clutch. As the fastener moves still further into the work piece, the clutch becomes completely disengaged, thereby impeding the transmission of power to the fastener. As will be understood, therefore, the depth of the fastener's penetration is controlled by the relationship of the clutch to the nose piece. In view of the fact that the drive train is a given length, by extending the nose piece, the screw is not driven as deeply into the object as would be the situation when the nose is retracted, which would have the effect of increasing the depth of penetration into the given work surface.

While the prior-art drywall/deck guns have operated with varying degrees of success, they have several shortcomings which have detracted from their usefulness. In particular, such standard drywall/deck guns are difficult to utilize when installing fasteners in substrates which are located well above the head, or under the feet of an operator employing same. In this regard, standard deck guns have not been capable of being utilized with an extension because the magnet which typically holds the fastener to the rotatable bit will not secure the fastener to the bit with sufficient strength to allow control of the fastener at the extended length. Consequently, when an operator is employing same and installing fasteners into surfaces such as ceilings or floors of a dwelling, it is often necessary for the craftsman to employ a ladder, or be constantly bending over on his/her knees to reach the work surface.

Another deficiency of the prior-art devices is that many employ a secondary screw holding assembly. In this regard devices are typically utilized during operations which are conducted at arm's length away from the user's body, or in some cases directly above the head of the operator. These prior-art devices have, in the past, been somewhat heavy and cumbersome and therefore the prior-art devices reduce the efficiency of a user by contributing to fatigue.

Yet another deficiency attendant with the prior-art screw holding devices is their complexity of design. In this regard, it should be understood that the complexity of design increases the likelihood that such screw holding devices will fail, jam or otherwise malfunction during operation when they are exposed to dust or debris which is typically generated during their use. Further, and as should be readily apparent, the complex design of these screw holding devices increases the manufacturing costs of same.

Therefore, it has long been known that it would be desirable to have an apparatus for facilitating the installation of screws and which is particularly well suited to retain a screw in tight engagement with respect to a bit of a screw driving means and which further is operable to automatically release the screw upon engagement of the apparatus with a work piece or surface, and wherein the apparatus works in combination with a standard drywall/deck gun and which can further be operated at a given length away from the drywall/deck gun thereby facilitating the installation of fasteners in objects of interest which are more than an arm's length away from an operator.

3. Objects and Summary of the Invention

Therefore, it is an object of the present invention to provide an improved fastener support apparatus.

Another object of the present invention is to provide an apparatus which is operable to obtain the individual benefits to be derived from related prior-art devices and practices while avoiding the detriments individually associated therewith.

Another object of the present invention is to provide an apparatus which is operable to facilitate the installation of individual fasteners into a work piece which is located a given distance beyond the end of the drywall/deck gun which employs same.

Another object of the present invention is to provide an apparatus which can be readily retrofitted on a standard drywall/deck gun without requiring any substantial modifications or alterations of same.

Another object of the present invention is to provide an apparatus which is operable to securely position a screw in tight engagement with a bit of a powered drywall/deck gun throughout the screw installation cycle, and which further automatically releases the screw when the apparatus comes into contact with or otherwise engages the work piece or surface.

Another object of the present invention is to provide an apparatus which reliably countersinks a fastener to a given depth in an object of interest.

Another object of the present invention is to provide an apparatus which is of relatively nominal cost to purchase and maintain and which further is inexpensive to operate.

Another object of the present invention is to provide an apparatus which is characterized by ease of employment and simplicity of construction.

Further objects and advantages of the present invention are to provide improved elements and arrangements thereof in an apparatus for the purposes described and which is dependable, economical, durable, and fully effective in accomplishing its intended purposes.

These and other objects and advantages are achieved in a fastener support apparatus for facilitating the installation of individual fasteners into a work surface, and wherein the fastener support apparatus operates in combination with a drive assembly having a clutch, the fastener support apparatus including a drive shaft oriented in force receiving relation relative to the clutch; a depth adjustment assembly located in a predetermined orientation relative to the drive shaft and operable for movement along a path of travel which is substantially coaxially aligned relative to the drive shaft; a rotatable bit for engaging the head of the fastener and which is disposed in force receiving relation to the drive shaft; a base member fixed on the rotatable bit and simultaneously rotatable therewith; a sleeve telescopingly borne by the base and reciprocally moveable relative thereto; a fastener support assembly reciprocally borne by the base member and matingly interfitted with the sleeve, the fastener support assembly including a passageway defining a fastener receiving station which is operable to receive the head of the screw; a locking assembly borne by the screw support assembly and operable to travel from a first partially occluded position relative to the passageway to a second substantially non-occluding position; and an actuating assembly borne by the fastener support assembly and which positions the locking assembly in the first or second positions, and wherein the actuating assembly is freely rotatable relative to the fastener support assembly, and wherein, during operation, the locking assembly when disposed in the first partially occluding position retains the head of the fastener in the fastener receiving station, and when disposed in the second substantially non-occluding position releases the fastener from the fastener receiving station such that the fastener may be driven completely into the work surface.

DETAILED DESCRIPTION OF THE PREFERRED EMBODIMENT

Figure 1:
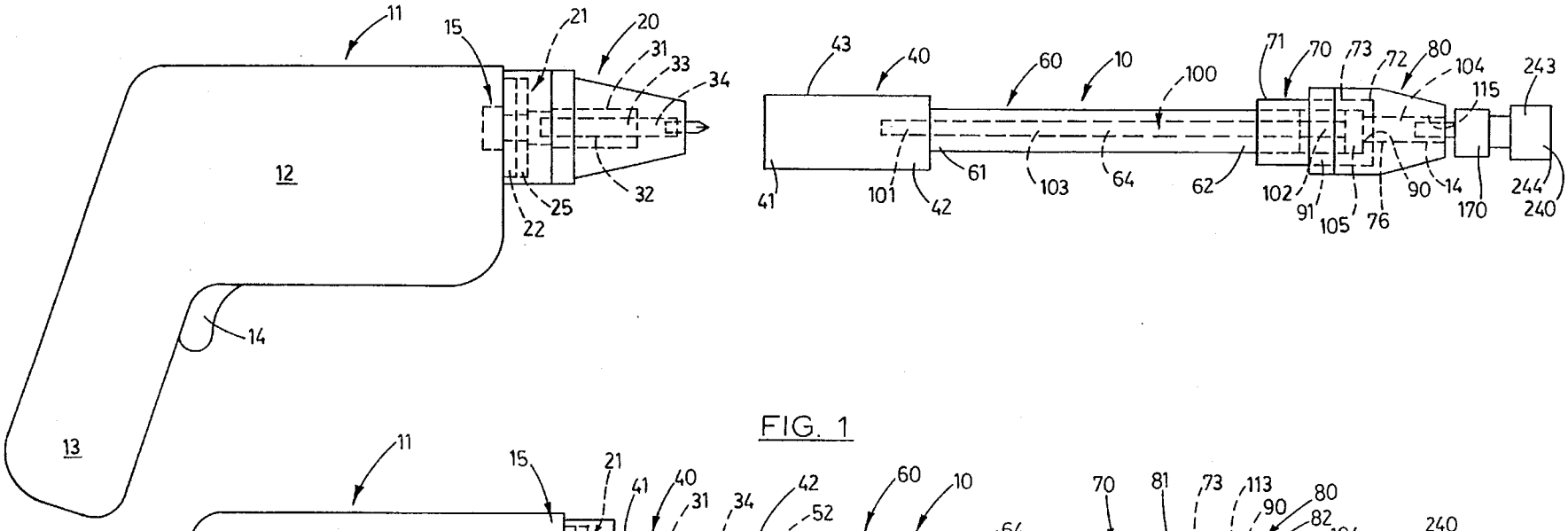
FIG. 1 is a side elevation view of the fastener support apparatus of the present invention, along with a standard drywall/deck gun with some underlying surfaces shown in phantom lines to illustrate the structure thereunder.
Figure 3A:
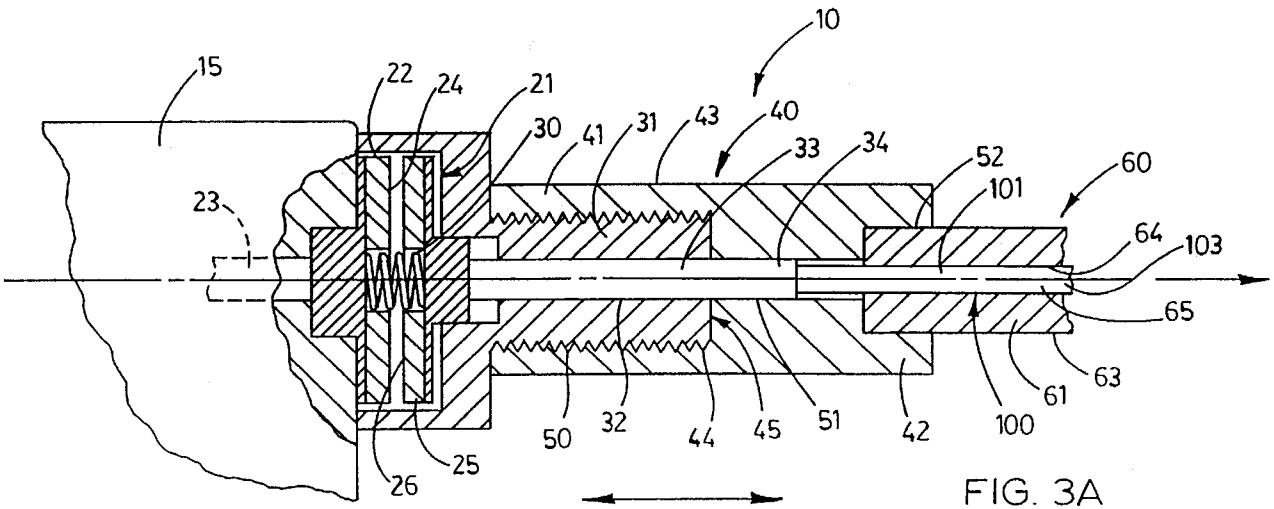
FIG. 3A is a somewhat enlarged, fragmentary, longitudinal, vertical, sectional view taken from a position along line 3—3 of FIG. 2.
Figure 3B:
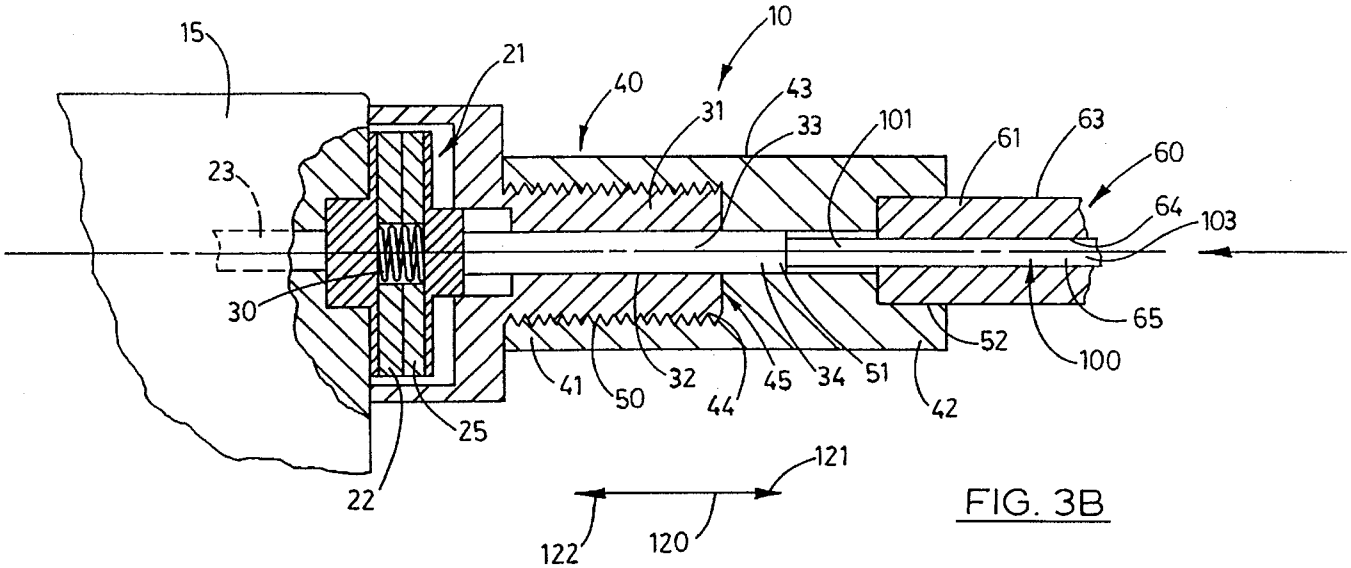
FIG. 3B is a second, fragmentary, somewhat enlarged, longitudinal, vertical, sectional view taken from a position along line 3—3 of FIG. 2.

The apparatus of the present invention is generally indicated by the numeral 10 in FIG. 1. As shown therein, the apparatus 10 of the subject invention is illustrated prior to installation on a drywall/deck gun of conventional design and which is generally indicated by the numeral 11. The drywall/deck gun 11 has a main body 12 which includes a handle 13 which may be gripped by the hand of an operator, not shown, and further has a trigger 14 which can be engaged by the operator thereby energizing the same assembly. Further, the main body 12 has a nose 15 which generally includes an adjustable nose piece 20. As should be understood, the nose piece is operable to be threadably advanced or retracted relative to the main body 12. This movement of the nose piece sets or otherwise determines the depth of penetration of an associated threaded fastener which will be discussed in greater detail hereinafter. As best seen by reference to FIG. 3A and 3B, the main body 12 includes a clutch which is generally indicated by the numeral 21. The clutch includes a first clutch plate or disc 22 which is disposed in driving relation relative to the main body 12 of the drywall gun 11 by means of a motor shaft 23 which is shown in phantom lines in FIG. 3A. Further, the first clutch plate 22 has a face which is generally designated by the numeral 24. The second clutch plate 25 has a corresponding face 26 which is operable to matingly interfit in driving relation relative to the first clutch plate. As best seen in FIGS. 3A and 3B respectively, a biasing means 30, herein illustrated as a spring, is disposed intermediate the first and second clutch plates and is operable to urge the first and second clutch plates into a disengaged position (FIG. 3A). As best seen in FIG. 3B, the clutch plates are shown in an engaged, power-transmitting orientation, and wherein the clutch plates are in face-to-face, frictionally engaging relation and thereby are operable to transmit force from the engine (not shown), which is enclosed in the main body 12 of the drywall/deck gun, to the fastener engaging bit which will be discussed in further detail hereinafter. As best seen in FIG. 3A, the nose 15 includes a threaded portion or extension 31 which has a passageway 32 formed therein. Further, a power-transmission shaft 33 is received in the passageway 32 and is fixed on the second clutch plate 25. The shaft 33 has a distal end 34 which is operable to matingly interfit with a drive shaft, which will be discussed in greater detail hereinafter. As best seen by a comparison of FIG. 1, and 3A, the nose piece 20 is threadably removed from the nose 15 thereby permitting the apparatus 10 to be matingly interfitted in operable relation thereto.

Figure 2:
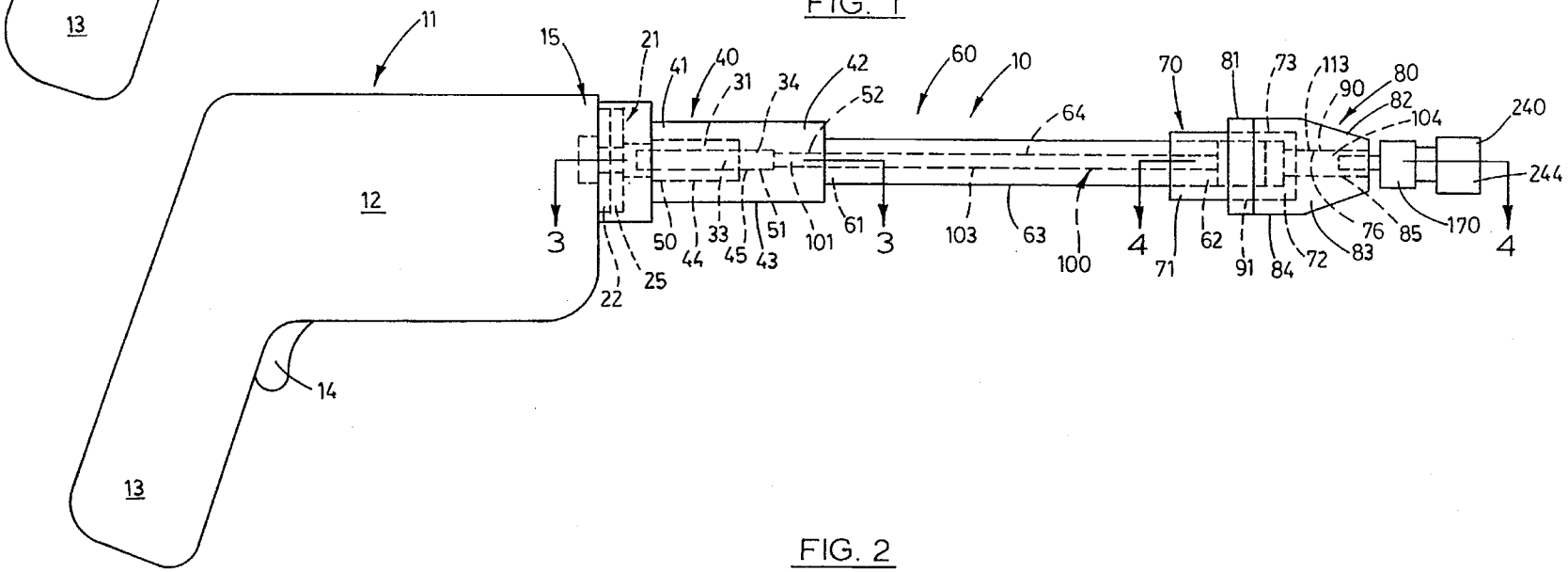
FIG. 2 is a side elevation view of the apparatus of the subject invention shown in an installed configuration on a drywall/deck gun, and wherein the nose piece of the drywall/deck gun has been removed to facilitate the installation of same.
Figure 4A:
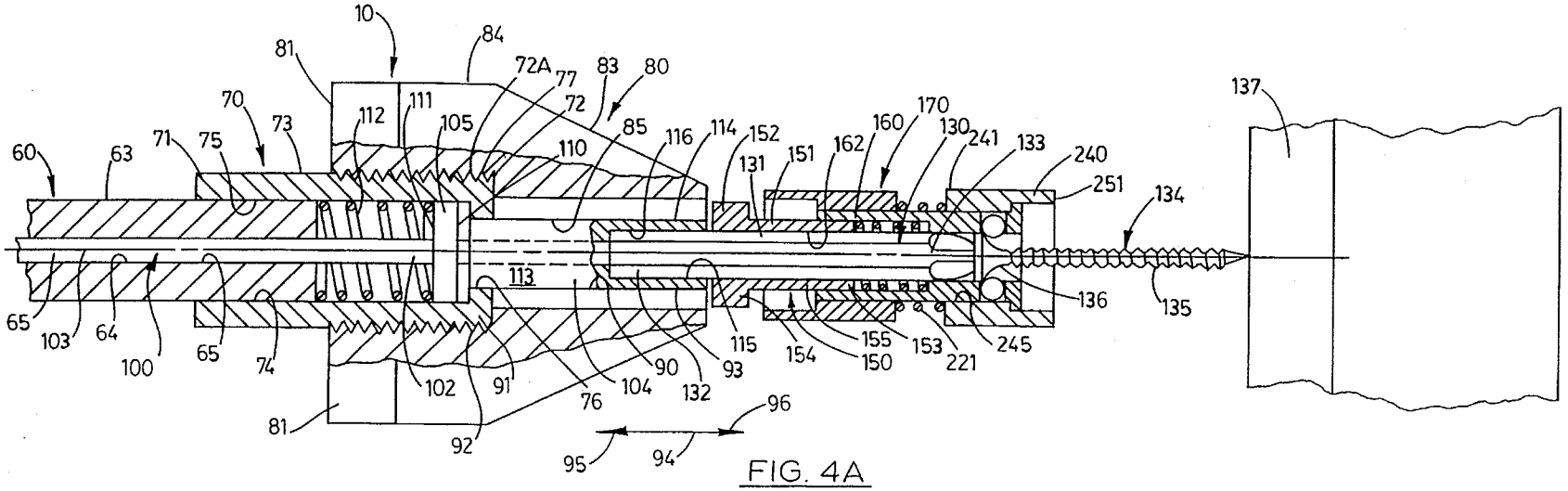
FIG. 4A is a somewhat enlarged, fragmentary, longitudinal, vertical, sectional view taken from a position along line 4—4 of FIG. 2.
Figure 4B:
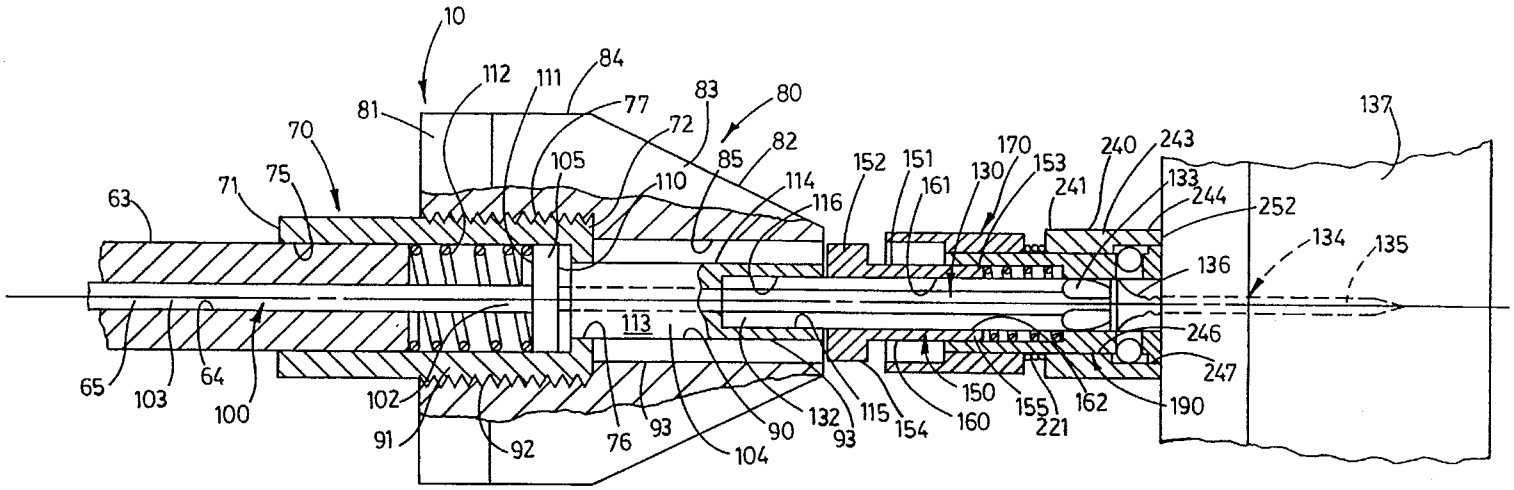
FIG. 4B is a second, somewhat enlarged, fragmentary, longitudinal, vertical, sectional view taken from a position along line 4—4 of FIG. 2.
Figure 4C:
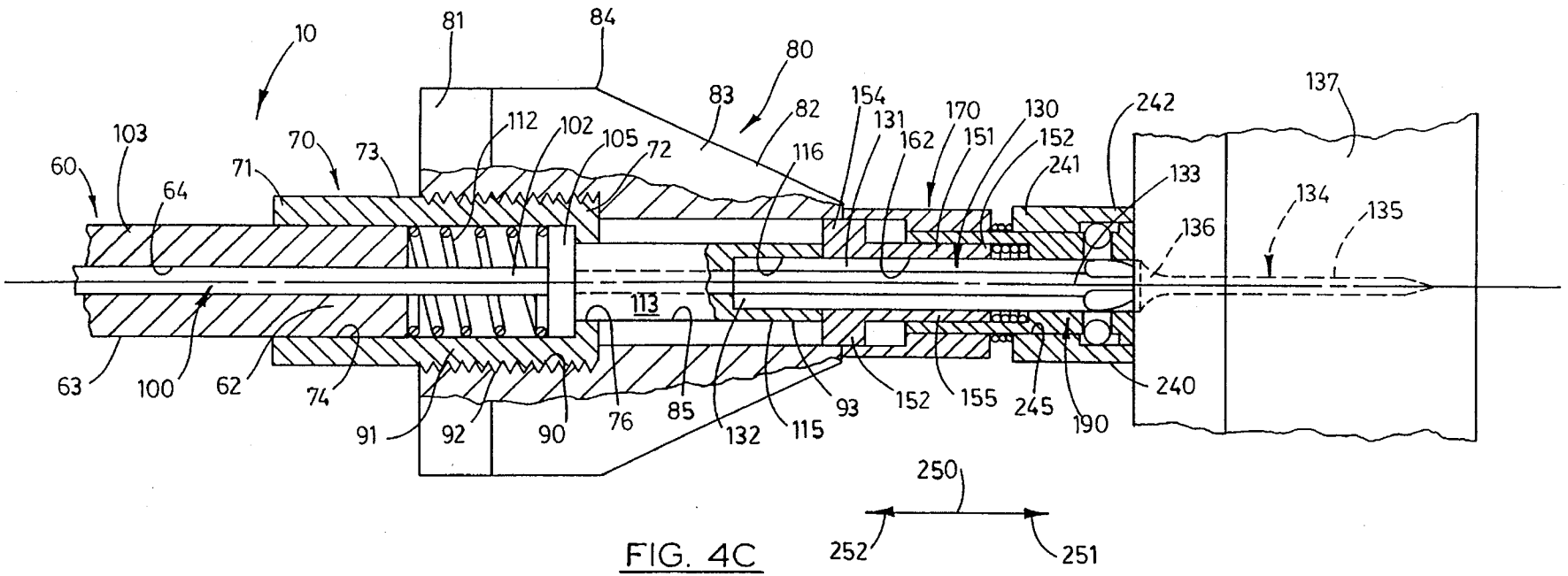
FIG. 4C is a third, somewhat enlarged, longitudinal, vertical, sectional view taken from a position along line 4—4 of FIG. 2.
Figure 5:
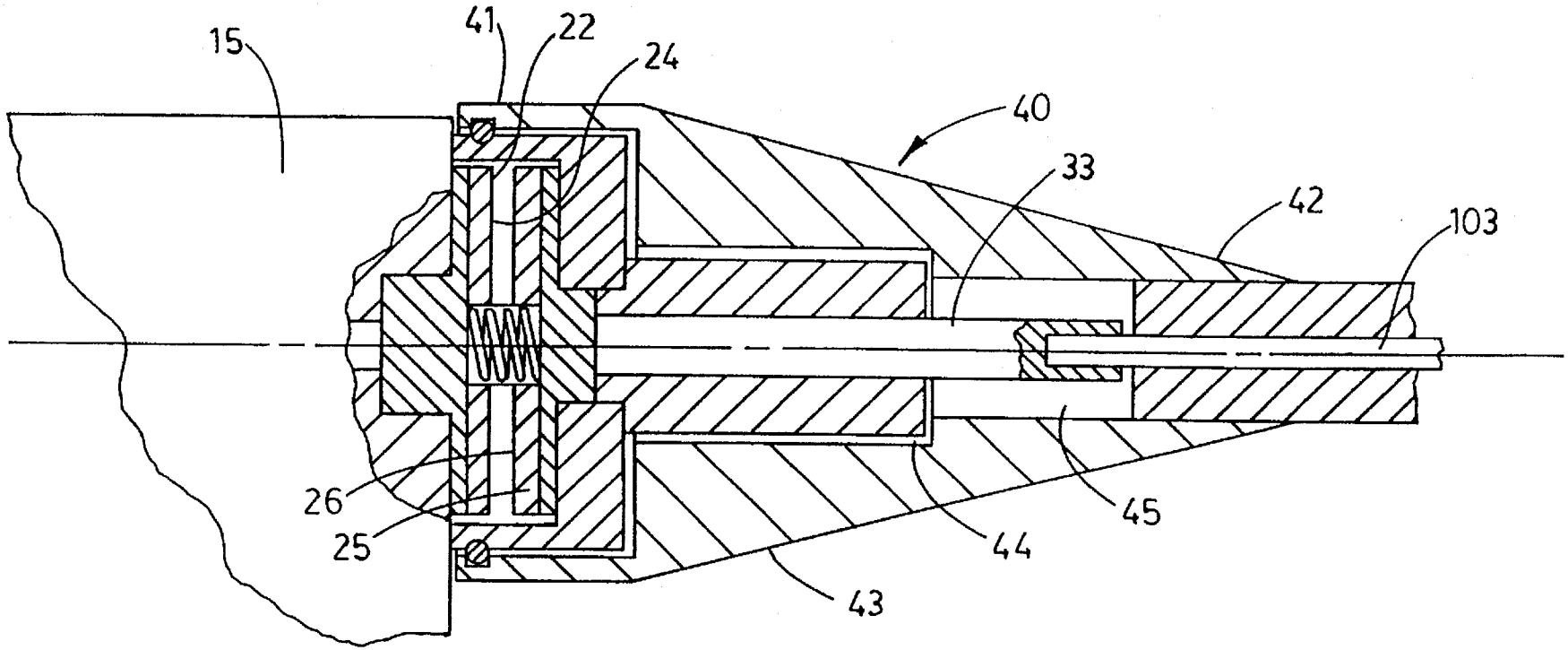
FIG. 5 is a somewhat enlarged, fragmentary longitudinal vertical sectional view of an alternate form of the connector employed with the present invention.

As best seen by references to FIGS. 1, 2, 3A, 3B, and 5 respectively, the apparatus 10 of the subject invention includes a connector assembly which is generally indicated by numeral 40. As discussed above, the apparatus 10 of the subject invention is operable to matingly interfit with the drywall/deck gun 11. To render the present invention operable, and as discussed above, the nose piece 20 is threadably disengaged from the threaded extension 31 and the connector 40 is threadably mated in receipt therewith. In one alternative form, as shown in FIG. 5, the connector may be designed to interfit in the manner of a snap-fit with more recent vacations in the drywall/deck gun 11. As best seen in FIGS. 3A and 3B respectively, the connector 40, has a first or proximal end 41, and an opposite, second, or distal end 42. Further, the connector 40 has a exterior facing surface 43, and an opposite or interior facing surface 44 which defines a passageway 45 which extends from the first to the second end. As best seen by reference to FIG. 3A, the passageway 45 includes a proximal, threaded passageway portion 50 which is operable to threadably engage the extension 31. Further, it has a central portion 51 which has a dimension which rotatably accommodates or receives the shaft 33 therein. Finally, the passageway 45 has a distal portion 52 which is operable to matingly engage, in the manner of a friction fit, an enclosure which is generally indicated by the numeral 60. As best seen in FIGS. 4A through 4C, respectively, the enclosure 60 has a first or proximal end 61, and an opposite second, or distal end 62. Further, the enclosure has an exterior facing surface 63, and an opposite interior facing surface 64 which defines a passageway 65. The passageway is substantially coaxially aligned relative to the passageway 45 which is defined by the connector 40. As best seen in FIG. 2, the enclosure extends substantially linearly outwardly relative to the drywall/deck gun 11 and is operable to rotatably support the drive shaft, which will be discussed in greater detail hereinafter. Fixed on the distal end 62, of the enclosure is a nose flange which is generally indicated by the numeral 70. The nose flange 70, has a first or proximal end 71, and an opposite second, or distal end 72. Further, the nose flange has an exterior facing surface 73 which has a plurality of threads 72A formed therein, and an opposite or interior facing surface 74 which defines a passageway 75 having predetermined dimensions. The passageway 75 extends from the first to the second ends 71 and 72. Further, an aperture 76 of predetermined dimensions is formed in the distal end 72 of the nose flange 70 and is operable to receive the drive shaft which was mentioned above and which will be discussed in greater detail hereinafter.

As best seen by references to FIGS. 4A and 4B, the apparatus 10 includes a depth adjustment assembly which is generally designated by the numeral 80. The depth adjustment assembly has a first, or proximal end 81, and an opposite, second, or distal end 82. The depth adjustment assembly further has a main body 83 which has an exterior facing surface 84, which is substantially frusto-conically shaped, and an interior facing surface 85, which defines a passageway 90 having predetermined diametral dimensions. In this regard, the passageway has a first portion 91 which is located near the proximal end 81 of the depth adjustment assembly 80. A plurality of threads 92 are formed in the interior facing surface 85 in the area of the first portion 91. The individual threads 92 are operable to matingly engage the individual threads 72A which are formed on the exterior facing surface 73 of the nose flange 70. Further, the passageway 90 has a second portion 93 having a reduced diametral dimension and which is operable to receive the extreme distal end of the drive shaft, which will be discussed in greater detail hereinafter. As best seen by reference to FIG. 4A, the depth adjustment assembly 80 is coaxially moveable relative to the distal end 63 of the enclosure 60 and along a path of travel 94 from a first position 95, and a second position 96, it being understood that the movement of the depth adjustment assembly 80 along this respective path of travel has the effect of controlling the depth of penetration of the fastener into the associated work surface. The specifics of the operation of the present device will also be discussed in greater detail hereinafter.

As mentioned earlier, the apparatus 10 of the subject invention includes a drive shaft which is generally indicated by the numeral 100 and which is operable to be selectively placed in force receiving relation relative to the motor (not shown) of the drywall/deck gun 11. In this regard, the drive shaft has a first or proximal end 101 which is disposed in force receiving relation relative to the distal end 34 of the shaft 33. As noted earlier this first or proximal end 101 is connected to the distal end of the shaft in the manner of a friction-fit although other means of securing it to the distal end of the shaft will work with equal success. The drive shaft 100 further has a second or distal end 102, and a main body 103 which has substantially uniform dimensions throughout its entire length. Mounted on the second end 102 of the drive shaft is a bit engagement member which is generally indicated by the numeral 104. The bit engagement member 104 has a base portion 105 which has a predetermined diametral dimension which is slightly less than the diametral dimension of the passageway 75 which is formed in the nose flange 70. Additionally, the base portion 105 has a forwardly facing surface 110, and a rearwardly facing surface 111 which is made integral with the second distal end 102 of the drive shaft 100. As best seen by references to FIG. 4A through 4C respectively, a biasing spring 112 is received about the second or distal end 102 and is disposed in a position between the rearwardly facing surface 111, and the distal end 62 of the enclosure 60. As should be understood, the biasing spring 112 is operable to urge the drive shaft 100 to move in a direction which facilitates the separation of the second clutch plate 25 from the first clutch plate 22. In addition to the foregoing, the bit engagement member 104 further has an engagement portion 113, which is made integral with the base portion 105, and which extends substantially perpendicularly outward relative to the forwardly facing surface 170. The engagement portion has a diametral dimension which is less than the diametral dimension of the second portion 93 of the passageway 90. As should be understood, the drive shaft 100 is operable to freely rotate within this same passageway thereby imparting rotational movement to the drill bit which will be discussed in greater detail hereinafter.

The engagement portion 113 has an exterior facing surface 114, and an opposite interior facing surface 115 which defines a bit cavity 116. The bit cavity is operable to matingly interfit with the associated drill bit which has been referenced, above. As should be understood, the engagement portion 113 may be manufactured of various materials including magnetic substrates which would facilitate the securing of the drill bit in the bit cavity 116. As should be understood, the drive shaft 100 is operable to move along a path of travel 120 from a first position 121 whereby the respective clutch plates are disposed in spaced relation, one to the other, to a second position 122, wherein the clutch plates are urged into force receiving relation one to the other, thereby imparting rotational movement to the drive shaft 100 and the associated drill bit which will be discussed below.

As discussed briefly in the paragraph immediately above, the apparatus 10 of the subject invention includes a rotatable bit which is generally indicated by the numeral 130. The bit has a main body 131 which has a proximal end 132, which is operable to matingly interfit or otherwise be received in force receiving relation in the bit cavity 116. In such an orientation, the rotatable movement of the drive shaft 100 imparts a simultaneous rotation to the bit 130. The main body 131 further has an opposite, distal end 133, which is operable to engage a screw of conventional design 134. The screw has a threaded shaft 135, and an opposite head 136 which may be matingly engaged by the distal end 133 of the bit 130. The threaded shaft 135 is operable to engage an object of interest or a working surface which is generally indicated by the numeral 137.

Fastened on the main body 131 of the bit 130 is a base member 150. The base member has a main body 151, which has a first or proximal end 152, and an opposite, second, or distal end 153. The main body 150 includes a flange portion 154 which has a predetermined diametral dimension and which is located at the first end of the main body. Further, and extending normally outward relative to the flange portion is a barrel portion 155, which has a predetermined diametral dimension which is less than the diametral dimension of the flange portion. The main body 151 further has an exterior facing surface 160, and an opposite interior facing surface 161 which defines a passageway 162. The passageway 162 has a predetermined diametral dimension which is somewhat slightly greater than the outside diametral dimension of the main body 131 of the bit 130. This facilitates the rotatable mating receipt of the bit relative to the passageway 162. This is best understood by a study of FIGS. 4A through 4D, respectively.

Figure 4D:
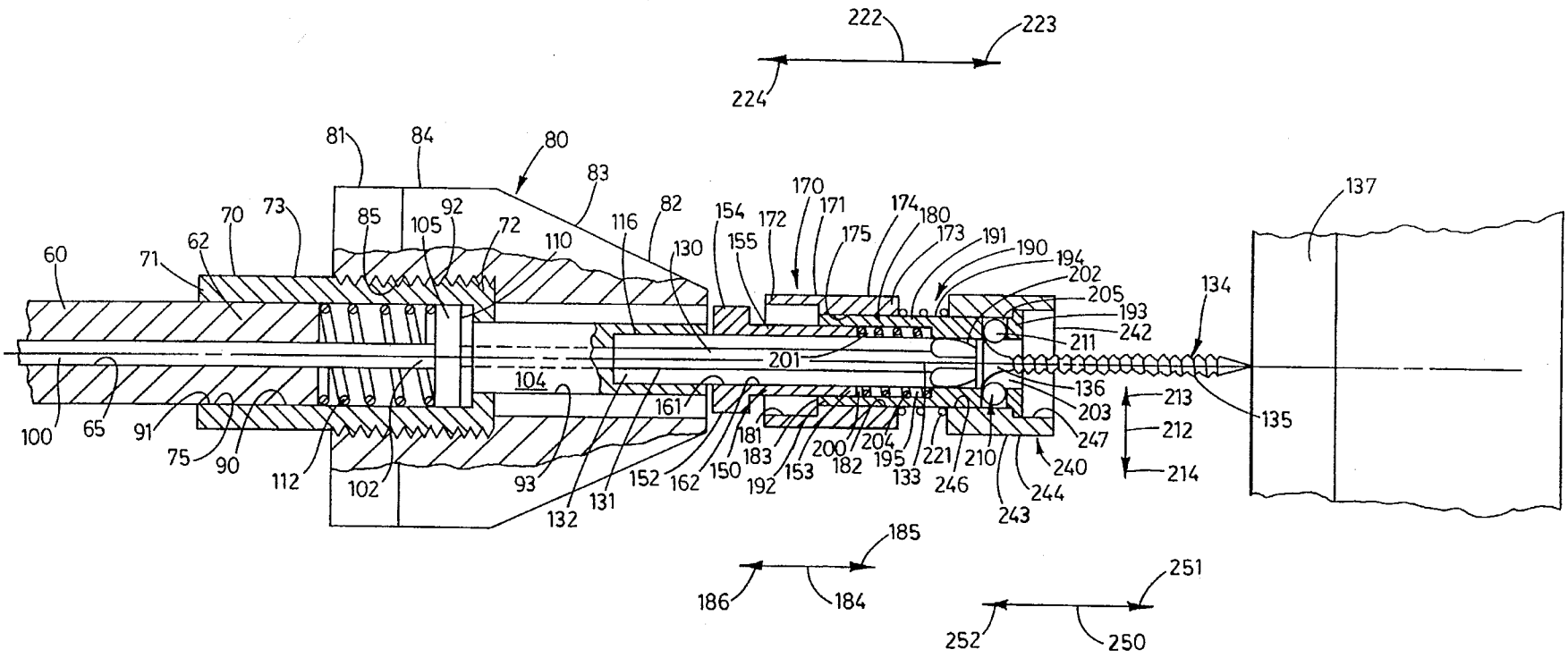
FIG. 4D is a fourth, somewhat enlarged, longitudinal, vertical sectional view taken from a position along line 4—4 of FIG. 2.

As best seen by reference to FIG. 4D, the apparatus 10 of the subject invention includes a sleeve which is generally indicated by the numeral 170. The sleeve further has a main body 171 which has a proximal end 172, and an opposite distal end 173. Further the sleeve has an exterior facing surface 174 and an opposite interior facing surface 175 which defines a passageway 180 having predetermined dimensions. As best seen by reference to FIG. 4D, the passageway 180 has a first portion 181 which has a predetermined cross sectional dimension which is slightly greater than the outside diametral dimension of the flange portion 154 and which is made integral with the main body 151 of the base 150. In such an arrangement, the flange is operable to be matingly received in interfitted, telescoping relation internally to the first portion 181 when the sleeve 170 reciprocally moves along the barrel portion 155 of the base member 150. This relationship is seen in FIG. 4C. Further, the passageway 180 has a second portion 182 which is separated from the first portion 181, by a substantially circumscribing flange 183. The flange defines an aperture having a diametral dimension which is slightly greater than the outside diametral dimension of the barrel portion 155. This facilitates the telescoping receipt of the barrel portion 155 and thereby slideably orients the sleeve for reciprocal movement along the barrel portion, as discussed above. As should be understood, the sleeve 170 is operable to reciprocally move along a predetermined path of travel 184 from a first position 185, wherein the sleeve is disposed in spaced relation relative to the distal end 82 of the depth adjustment assembly 80, to a second position 186, wherein the proximal end 172 of the sleeve 170 is moved into contact with the depth adjustment assembly. This is shown most clearly by reference to FIG. 4C.

Referring again to the somewhat enlarged view of FIG. 4D, the apparatus 10 includes a screw support assembly which is generally indicated by the numeral 190. The screw support assembly 190 includes a main body 191 which has a first end 192, and an opposite, second end 193. Further, the main body has an exterior facing surface 194, and an opposite, interior facing surface 195. The interior surface defines a channel or passageway which is generally indicated by the numeral 200. The channel or passageway 200 includes a first bore 201, which has a predetermined diametral dimension which is just slightly greater than the outside diametral dimension of the barrel portion 155 of the base member 150; and a second bore 202 which is substantially coaxially aligned therewith and which has a decreased diametral dimension in relative comparison to the first bore. As shown in the drawings, the second bore defines a fastener or screw receiving station 203 which is operable to receive the head of the screw or fastener 134. The first bore 201 is operable to receive a biasing assembly herein illustrated as a spring 204. The spring 204 engages the barrel portion 155 of the base member 150, and is operable to bias the screw support assembly 190 and the associated sleeve 170, in a direction away from the depth adjustment assembly 80. As best seen in FIG. 4D, the first end 192 of the screw support assembly 190 is telescopingly received in mated relation internally of the second portion 182 of the passageway 180 which is defined by the sleeve 170. In particular, it should be understood that the sleeve 170, and the screw support assembly 190 move together in unison along the earlier described reciprocal path of travel 184 from a first position 185, wherein the sleeve is located in spaced relation relative to the distal end of the depth adjustment assembly 80, to a second position 186, wherein the proximal end of the sleeve 170 is placed in contact with the depth adjustment assembly 80. As further seen in FIG. 4D, the biasing spring 204 as earlier discussed is located in the first bore 201. As should be understood, the apparatus 10 includes a pair of posts, not shown, which are mounted on the main body of the screw support assembly 190 and which extend substantially radially inwardly relative thereto and which engage the barrel portion of the base member. The individual posts are operable to be received in coaxially aligned channels, not shown, which are formed in the barrel portion. These posts and channel cooperate in a fashion to render the sleeve, and screw support assembly, coaxially and reciprocally moveable relative to the base member.

As best seen is FIG. 4D, a plurality of apertures are formed in the second end 193, of the main body 191 and are thereby operable to receive a locking assembly which is generally designated by the numeral 210. The locking assembly includes individual spherical members 211. The individual spherical members are operable to move along a substantially transversely oriented path of travel, from a first, partially occluding position 213 wherein individual spherical members are operable to impede movement of the head of the fastener 136 from the screw receiving station, to a second, substantially non-occluding position 214 which releases the head of the screw such that it may be countersunk into the object of interest 137.

A biasing spring 221 is placed in force engaging relation relative to the actuating assembly which is placed in rested relation against the sleeve 170. As should be understood, the screw support assembly is operable to move along a path of travel 222 from a first, extended position 223 to a second, retracted position 224. As best seen by reference to FIG. 4D, the apparatus 10 of the subject invention has an actuating assembly which is generally indicated by the numeral 240. The actuating assembly has a proximal end 241 and an opposite, distal end 242. Further the actuating assembly has a main body 243 which has an exterior facing surface 244, and an opposite, interior facing surface 245. The interior facing surface 245 defines a first bore 246 which has a predetermined diametral dimension which is just slightly greater than the outside diametral dimension of the screw support assembly 190. Further, it should be understood that the main body 243 is freely rotatable relative to the main body of the screw support assembly 190. Further, the interior facing surface 245 defines a second bore 247 which has a diametral dimension which is greater than the first bore, in relative terms, and which facilitates the movement of the locking assembly 210 along its respective path of travel. As should be understood, the actuating assembly 240 is moveable along a substantially coaxially oriented and reciprocal path of travel 250 from a first, extended position 251 to a second, retracted position 252. As should be understood, as the actuating assembly moves along the path of travel 250 from the first, extended position to the second, retracted position, the spherical members 211 are permitted to move along their respective paths of travel 212, from their partially occluding position 213, to their substantially non-occluding position 214 thereby releasing the screw 134 from the screw receiving station 203.

OPERATION

The operation of the described embodiment of the present insertion is believed to be readily apparent and is briefly summarized at this point.

As should be understood, upon contact with the work piece, force applied by the operator causes the bit 130 to be urged rearwardly by forcing the drive shaft 100 along its path of travel 120, from the first position 121, wherein the individual clutch plates are disposed in spaced relation, to the second position 122, wherein the clutch plates are placed in force transmitting relation together, thereby allowing the drywall gun to impart rotational movement to the bit. As the screw 134 is advanced into the work piece, the clutch plates remain in contact. As best seen by reference to FIG. 4B, when the actuating assembly comes in contact with the work surface 137, the actuating assembly 240 is urged rearwardly against the influence of the spring 221 and along its respective path of travel 250 from the first, extended position to the second, retracted position 252. Upon reaching the second, retracted position 252, the several spherical members 211 of the locking assembly 210 move along their respective paths of travel 212 from the first, partially occluding position 213, to the second, non-occluding position 214, thereby releasing the head 136 of the screw 134 from the screw receiving station 203. This is best seen by reference to FIG. 4C.

As continued force is applied by the operator, the screw support assembly 190 is urged rearwardly along its respective path of travel 222 from the first, extended position 223 to the second, retracted position 224. As noted earlier, the screw support assembly, and associated sleeve 170 move in unison along the path of travel 184 from the first, spaced position 185 to the second position 186 whereby they are moved into contact with the depth adjustment assembly 80 thereby impeding further movement. It should be understood that the movement of the sleeve 170, and the associated screw support assembly 190 is against the biasing force of the springs 204 and 112, respectively, each of which is located in the first bore 201 of the screw support assembly 190, and the nose flange 70, respectively. As noted above, when the sleeve contacts the depth adjustment assembly further movement is impeded. Therefore, the associated screw is driven to the given depth as determined by the depth adjustment assembly. To adjust the depth of penetration the operator would merely threadably advance or retract the depth adjustment assembly by moving it along its path of travel 94.

As rotatable force is continued to be imparted to the associated screw 134, the screw moves deeper into the associated work surface 137 until such time as the spring 212, which acts in combination with the spring 30 which is disposed between the individual clutch plates 22 and 28, respectively, overcomes the force of the bit engaging the screw. When this event occurs, the clutch plates disengage or separate, thereby impeding further rotational movement of the bit, and thus stopping penetration of the screw into the object of interest.

As discussed above, the threadable advancement, or retraction of the depth adjustment assembly 80 relative to the enclosure 60 controls the depth with which the associated threaded fastener 134 is advanced into the work surface 137. It should be understood that the threaded advancement of the depth adjustment assembly along its respective path of travel reduces the depth of penetration of the fastener and the retraction of the depth adjustment assembly causes the associated fastener to be countersunk to a greater depth.

As earlier discussed, the present form of the invention finds particular utility when employed with a standard drywall/deck gun and further has particular utility when utilized to install a working surface that includes panel-like members which may be located more than an arm's length away from the operator of the device.

Therefore, the apparatus 10 of the subject invention can be utilized on a conventional drywall/deck gun without further substantial modifications thereto. In addition, the present invention may be employed in all manner of commercial environments to expedite the assembly of various objects of commerce, and can be utilized for various home improvement projects and general construction. The apparatus can be easily installed on a drywall/deck gun and is simple to maintain and further can be manufactured at a nominal price when compared with other prior-art devices which are utilized for substantially identical purposes.

While the invention has been herein shown and described in what is perceived to be the most practical and preferred embodiment, it should be recognized that departures may be made therefrom within the scope of the invention which is not to be limited to the illustrative details disclosed.

Having described my invention, what I claim as new and desire secured by Letters Patent is:

1. A fastener support apparatus for facilitating the installation of individual screws into a work surface, and wherein the fastener support apparatus works in combination with a drive assembly having a clutch, the fastener support apparatus comprising:

a drive shaft oriented in force receiving relation relative to the clutch and moveable along a given path of travel;

a depth adjustment assembly located in a predetermined orientation relative to the drive shaft and operable for movement along a path of travel which is substantially coaxially aligned relative to the drive shaft;

a rotatable bit for engaging the head of the screw and which is disposed in force receiving relation relative to the drive shaft;

a base member fixed on the rotatable bit, and simultaneously rotatable therewith;

a sleeve telescopingly borne by the base member and reciprocally moveable relative thereto;

a screw support assembly reciprocally borne by the base member and matingly interfitted with the sleeve, the screw support assembly including a passageway defining a screw receiving station which is operable to receive the head of the screw;

a locking assembly borne by the screw support assembly and operable to travel from a first, partially occluding position relative to the passageway to a second, substantially non-occluding position; and an actuating assembly borne by the screw support assembly, and which positions the locking assembly in the first, partially-occluding position or the second, substantially non-occluding position, and wherein the actuating assembly is freely rotatable relative to the screw support assembly, and wherein during operation, the locking assembly, when disposed in the first partially occluding position retains the head of the screw in the screw receiving station, and when disposed in the second, substantially non-occluding position releases the screw from the screw receiving station such that the screw may be driven completely into the work surface.

2. A fastener support apparatus as claimed in claim 1, and wherein the apparatus further includes a connector for releasably mating with the drive assembly, and wherein the connector has a first passageway that is formed therein, and which receives the drive shaft, and wherein the apparatus further includes an enclosure which is borne by the connector and which extends substantially linearly outwardly relative thereto, and wherein the enclosure defines a second passageway which is substantially coaxially aligned relative to the first passageway, and further has a proximal end which is mounted on the connector, and an opposite, distal end which is remote thereto, and wherein the second passageway is operable to receive the drive shaft.

3. A fastener support apparatus as claimed in claim 2, and wherein the depth adjustment assembly is borne by the distal end of the enclosure and is coaxially moveable relative thereto along a given path of travel, and wherein the depth adjustment assembly defines a third passageway which is substantially coaxially aligned relative to the first and second passageways, and wherein the depth adjustment assembly has a proximal end, and an opposite distal end, and wherein the apparatus further includes a biasing means which is borne by the drive shaft and which acts in combination with the enclosure to urge the drive shaft in a direction which disengages the clutch.

4. A fastener support apparatus as claimed in claim 3, and wherein the rotatable bit is releasably mounted on the distal end of the drive shaft and is received in the third passageway, and wherein the base member has a main body which includes a flange having a given dimension, and a central portion having a reduced dimension, and wherein the main body of the base member defines a fourth passageway which is substantially coaxially aligned relative to the third passageway, and which receives the rotatable bit.

5. A fastener support apparatus as claimed in claim 4, and wherein the sleeve has a main body having proximal and distal ends, and an inside facing surface which defines a passageway having a predetermined dimension, and wherein the passageway defined by the sleeve has a first portion which is operable to telescopingly receive the flange of the base member, and a second portion which is operable to telescopingly and matingly interfit with the screw support assembly, and wherein the sleeve, and screw support assembly move together along a reciprocal path of travel from a first position, wherein the sleeve is located in spaced relation relative to the distal end of the depth adjustment assembly, to a second position, wherein the proximal end of the sleeve is placed in contact with the depth adjustment assembly.

6. A fastener support apparatus as claimed in claim 5, and wherein the screw support assembly has a main body which includes proximal and distal ends, and wherein the proximal end is telescopingly received in the second portion of the passageway which is defined by the sleeve, and wherein the central portion of the base member is telescopingly received in the passageway defined by the screw support assembly, and wherein a second biasing assembly is borne by the screw support assembly and is operable to urge the screw support assembly and the sleeve in the direction of the first position.

7. A fastener support apparatus as claimed in claim 6, and wherein the actuating assembly is moveable along a given path of travel thereby positioning the locking assembly in the first, partially occluding position, and the second substantially non-occluding position, and wherein the screw support assembly includes a third biasing means which urges the actuating assembly along the path of travel thereby causing the locking assembly to be disposed in the first partially occluding position.

8. A fastener support apparatus for facilitating the installation of individual screws into a work surface, and wherein the fastener support apparatus is mounted on a drive assembly having a clutch, the fastener support apparatus comprising:

a connector for releasably mating with the drive assembly;

an enclosure borne by the connector and extending outwardly a given distance therefrom;

a drive shaft rotatably borne by the enclosure and mounted in force receiving relation relative to the drive assembly, the drive shaft reciprocally moveable along a predetermined path of travel;

a depth adjustment assembly movably borne by the enclosure and operable for travel along a given path of travel;

a rotatable bit for engaging the head of a screw and which is mounted on the drive shaft;

a base member borne by the rotatable bit, and simultaneously rotatable therewith;

a sleeve borne by the base member and reciprocally moveable along a given path of travel;

a screw support assembly movably borne by the base member and matingly engaging the sleeve, the screw support assembly including a passageway defining a screw receiving station which is operable to receive the head of the screw;

a locking assembly borne by the screw support assembly and operable for travel from a first, partially occluding position relative to the passageway, to a second, substantially non-occluding position; and an actuating assembly borne by the screw support assembly, and which positions the locking assembly in the first or second positions, and wherein the actuating assembly is freely rotatable relative to the screw support assembly, and wherein during operation, the locking assembly when disposed in the first partially occluding position retains the head of the screw in the screw receiving station, and when disposed in the second, substantially non-occluding position releases the screw from the screw receiving station such that the screw may be driven completely into the work surface.

9. A fastener support apparatus as claimed in claim 8, and wherein the connector has proximal and distal ends, and further defines a first passageway, and wherein the first passageway receives the drive shaft, and wherein the drive shaft is disposed in force transmitting relation relative to the clutch.

10. A fastener support apparatus as claimed in claim 9, and wherein the enclosure has opposite proximal and distal ends, and further defines a second passageway which is substantially coextensive with the first passageway, and wherein the drive shaft is received in the second passageway.

11. A fastener support apparatus as claimed in claim 10, and wherein a nose flange is matingly interfitted on the distal end of the enclosure, and wherein the nose flange has an exterior surface which matingly interfits with the depth adjustment assembly, and wherein the nose flange facilitates the selective positioning of the depth adjustment assembly along its given path of travel.

12. A fastener support apparatus as claimed in claim 11, and wherein the nose flange defines a passageway which telescopingly receives the distal end of the enclosure, and wherein a biasing assembly is received in the passageway and is operable to act upon the drive shaft thereby urging it in a predetermined direction.

13. A fastener support assembly as claimed in claim 12, and wherein the rotatable bit is releasably mounted on the drive shaft, and the base member includes a flange and a passageway which receives the rotatable bit, and wherein the sleeve defines a passageway which includes a first and a second portion, and wherein the first portion of the passageway is operable to telescopingly receive the flange and the second portion of the passageway is operable to telescopingly mate with the screw support assembly, and wherein the screw support assembly and the sleeve are moveable in unison along a given path of travel from a first position wherein they are disposed in spaced relation relative to the depth adjustment assembly, to a second position, wherein they are in contact with same.

14. A fastener support assembly as claimed in claim 13, and wherein the actuating assembly is moveable along a given path of travel thereby positioning the locking assembly in the first partially occluding position, and the second substantially non-occluding position, and wherein the screw support assembly includes a third biasing means which urges the actuating assembly along the path of travel thereby causing the lock assembly to be disposed in the first partially occluding position.

15. A fastener support apparatus for use with a drive assembly having a clutch, the fastener support assembly comprising:

a connector for releasably mating with the drive assembly, and wherein the connector has opposite first and second ends, and further defines a first passageway which extends from the first to the second end;

an enclosure borne by the connector and extending outwardly a given distance therefrom, and wherein the enclosure has first and second ends, and defines a second passageway which extends from the first to the second end, and further is substantially coaxially aligned relative to the first passageway;

a drive shaft rotatably borne by the enclosure and mounted in force receiving relation relative to the clutch, the drive shaft being reciprocally moveable along a predetermined path of travel, and wherein the drive shaft has a first end which is disposed in driving relation relative to the clutch and an opposite second end, and wherein the second end defines a cavity having predetermined dimensions;

a depth adjustment assembly borne by the second end of the enclosure and coaxially moveable along a given path of travel relative thereto, and wherein the depth adjustment assembly defines a third passageway which is operable to telescopingly receive the second end of the enclosure;

a biasing means borne by the enclosure and operable to urge the drive shaft in a predetermined direction along the path of travel of the drive shaft;

a rotatable bit for engaging the head of a screw and which is telescopingly received in the cavity of the drive shaft, and wherein rotatable movement of drive shaft is imparted to the rotatable bit;

a base member borne by the rotatable bit and simultaneously rotatable therewith, the base member having a main body with opposite first and second ends and further defining a fourth passageway, and wherein the fourth passageway is substantially coaxially aligned relative to the third passageway, and wherein the base member further has a circumscribing flange which is located on the first end;

a sleeve borne by the base member and reciprocally moveable along a given path of travel, and wherein the sleeve has a main body with opposite first and second ends, and wherein the main body defines a fifth passageway and wherein the main body further includes a second circumscribing flange which is disposed in partially occluding relation relative to the fifth passageway;

a screw support assembly movably borne by the base member and matingly engaging the sleeve, and wherein the screw support assembly has a main body with opposite first and second ends and further defining a sixth passageway, and wherein the second end of the base portion is telescopingly received in the sixth passageway, and wherein the sixth passageway further defines a screw receiving station which is operable to receive the head of the screw;

a biasing means borne by the screw support assembly and operable to urge the screw support assembly in a given direction;

a locking assembly borne by the screw support assembly and operable to travel from a first partially occluding position relative to the passageway to a second, substantially non-occluding position; and an actuating assembly borne by the screw support assembly, and which positions the locking assembly in the first or second positions, and wherein the actuating assembly is freely rotatable relative to the screw support assembly, and wherein during operation, the locking assembly when disposed in the first, partially occluding position retains the head of the screw in the screw receiving station, and when disposed in the second, substantially non-occluding position releases the screw from the screw receiving station such that the screw may be driven completely into the work surface.

16. A fastener support apparatus as claimed in claim 15, and wherein the sleeve and the screw support assembly move along a given path of travel from a first position, and wherein the sleeve is disposed a spaced relation relative to the depth adjustment member, to a second position wherein the sleeve is placed in contact with the depth adjustment member.

17. A fastener support apparatus as claimed in claim 16, and wherein a nose flange is borne by the second end of the enclosure and has an outside surface and defines a passageway, and wherein a biasing means is received in the passageway defined by the nose flange and is operable to act upon the drive shaft thereby urging the drive shaft in a direction whereby the clutch will disengage, and wherein the depth adjustment assembly releasably mates with the nose flange and facilitates the orientation of the depth adjustment assembly in a given position relative to the rotatable bit.

18. A fastener support apparatus as claimed in claim 17, and wherein the actuating assembly, when urged into contact with an object of interest, is moved along the respective path of travel thereby permitting the locking assembly to move from the partially occluding position to the non-occluding position, and wherein the screw support assembly when urged into contact with an object of interest moves from the first position, wherein the sleeve is disposed in spaced relation relative to the depth adjustment assembly to the second position where it is disposed in contact with the depth adjustment assembly, and wherein force applied to the rotatable bit urges the drive shaft into a position whereby the clutch is engaged and rotatable motion is imparted from the drive assembly to the rotatable bit, and wherein contact of the sleeve with the depth adjustment assembly limits the depth of penetration of the screw into the object of interest, and wherein upon reaching the predetermined depth of penetration, the biasing means overcomes the force exerted by the drill bit thereby disengaging the clutch.

19. A fastener support apparatus for facilitating the installation of individual screws into a work surface, and wherein the fastener support apparatus works in combination with a drive assembly having a clutch, the fastener support apparatus comprising:

a depth adjustment assembly;

a base member located in a predetermined orientation relative to the depth adjustment assembly;

a sleeve telescopingly borne by the base member and reciprocally moveable relative thereto;

a screw support assembly reciprocally borne by the base member and matingly interfitted with the sleeve, the screw support assembly including a passageway defining a screw receiving station which is operable to receive the head of the screw;

a locking assembly borne by the screw support assembly and operable to travel from a first partially occluding position relative to the passageway to a second, substantially non-occluding position; and an actuating assembly borne by the screw support assembly, and which positions the locking assembly in the first, partially occluding position or the second, substantially non-occluding position, and wherein the actuating assembly is freely rotatable relative to the screw support assembly, and wherein during operation, the locking assembly, when disposed in the first, partially occluding position retains the head-of the screw in the screw receiving station, and when disposed in the second, substantially non-occluding position releases the screw from the screw receiving station.

* * * * *